US006321462B1

(12) United States Patent
Seidl et al.

(10) Patent No.: US 6,321,462 B1
(45) Date of Patent: Nov. 27, 2001

(54) WEB DRYER WITH FULLY INTEGRATED REGENERATIVE HEAT SOURCE

(75) Inventors: Paul G. Seidl, De Pere; Michael P. Bria, Green Bay; Steve J. Zagar, Luxemburg; Andreas Ruhl, De Pere, all of WI (US)

(73) Assignee: Megtec Systems, Inc., DePere, WI (US)

( * ) Notice: Subject to any disclaimer, the term of this patent is extended or adjusted under 35 U.S.C. 154(b) by 0 days.

(21) Appl. No.: 09/673,427

(22) PCT Filed: May 5, 1999

(86) PCT No.: PCT/US99/09943

§ 371 Date: Nov. 22, 2000

§ 102(e) Date: Nov. 22, 2000

(87) PCT Pub. No.: WO99/57498

PCT Pub. Date: Nov. 11, 1999

Related U.S. Application Data

(60) Provisional application No. 60/084,603, filed on May 7, 1998.

(51) Int. Cl.[7] ..... F26B 7/00

(52) U.S. Cl. ..... 34/423

(58) Field of Search ..... 34/423, 420, 446, 34/448, 461, 539, 621, 629, 630, 638, 641, 643; 432/60; 110/210; 422/111, 115, 169, 180

(56) References Cited

U.S. PATENT DOCUMENTS

| | | |
|---|---|---|
| 4,146,361 | 3/1979 | Cirrito . |
| 4,989,348 | 2/1991 | Vits . |
| 5,333,395 | 8/1994 | Bulcsu . |
| 5,579,590 | 12/1996 | Seidl et al. . |
| 5,857,270 | 1/1999 | Bria . |

OTHER PUBLICATIONS

International Search Report dated Aug. 11, 1999.

*Primary Examiner*—Teresa Walberg
*Assistant Examiner*—Vinod D. Patel
(74) *Attorney, Agent, or Firm*—Mitchell D. Bittman; Kevin S. Lemack

(57) ABSTRACT

Integrated web dryer (10) and regenerative heat exchanger (20), as well as a method of drying a web of material using the same. The apparatus and method of the present invention provides for the heating (22) of air and the converting of VOC's to harmless gases in a fully integrated manner via the inclusion of a regenerative combustion device as an integral element of the drying apparatus.

18 Claims, 8 Drawing Sheets

WEB DRYER WITH FULLY INTEGRATED REGENERATIVE HEAT SOURCE

This application is a 371 of PCT/US99/09943, filed May 5, 1999, which claims benefit of provisional application 60/084,603, filed May 7, 1998.

BACKGROUND OF THE INVENTION

The control and/or elimination of undesirable impurities and by-products from various manufacturing operations has gained considerable importance in view of the potential pollution such impurities and by-products may generate. One conventional approach for eliminating or at least reducing these pollutants is by thermal oxidation. Thermal oxidation occurs when contaminated air containing sufficient oxygen is heated to a temperature high enough and for a sufficient length of time to convert the undesired compounds into harmless gases such as carbon dioxide and water vapor.

Control of web drying apparatus, including flotation dryers capable of contactless supporting and drying a moving web of material, such as paper, film or other sheet material, via heated air issuing from a series of typically opposing air nozzles, requires a heat source for the heated air. Additionally, as a result of the drying process, undesirable volatile organic compounds (VOCs) may evolve from the moving web of material, especially where the drying is of a coating of ink or the like on the web. Such VOCs are -mandated by law to be converted to harmless gases prior to release to the environment.

Prior art flotation drying apparatus have been combined with various incinerator or afterburner devices in a separated manner in which hot, oxidized gases are retrieved from the exhaust of the thermal oxidizer and returned to the drying device. These systems are not considered fully integrated due to the separation of oxidizer and dryer components and the requirement of an additional heating appliance in the drying enclosure. Other prior art systems combined a thermal type oxidizer integrally within the dryer enclosure, also utilizing volatile off-gases from the web material as fuel. However, this so-called straight thermal combustion system did not utilize any type of heat recovery device or media and required relatively high amounts of supplemental fuel, especially in cases of low volatile off-gas concentrations. Still other prior art apparatus combined a flotation dryer with the so-called thermal recuperative type oxidizer in a truly integrated fashion. One disadvantage of these systems is the limitation of heat recovery effectiveness due to the type of heat exchanger employed, thus preventing extremely low supplemental fuel consumption capabilities and often precluding any auto-thermal operation. This limitation in effectiveness results from the fact that a heat exchanger with high effectiveness will preheat the incoming air to temperatures high enough to cause accelerated oxidation of the heat exchanger tubes which results in tube failure, leakage, reduction in efficiency and destruction of the volatiles. In general, the thermal recuperative type device has a reduced reliability of system components such as the heat exchanger and burner due to the exposure of metal to high temperature in-service duty.

Yet another fully integrated system utilizes a catalytic combustor to convert off-gases and has the potential to provide all the heat required for the drying process. This type system can use a high effectiveness heat exchanger because the presence of a catalyst allows oxidation to occur at low temperatures. Thus, even a high efficiency heat exchanger can not preheat the incoming air to harmful temperatures.

However, a catalytic oxidizer is susceptible to catalyst poisoning by certain components of the off-gases, thereby becoming ineffective in converting these off-gases to harmless components. Additionally, catalytic systems typically employ a metal type heat exchanger for primary heat recovery purposes, which have a limited service life due to high temperature in-service duty.

For example, U.S. Pat. No. 5,207,008 discloses an air flotation dryer with a built-in afterburner. Solvent-laden air resulting from the drying operation is directed past a burner where the volatile organic compounds are oxidized. At least a portion of the resulting heated combusted air is then recirculated to the air nozzles for drying the floating web.

U.S. Pat. No. 5,210,961 discloses a web dryer including a burner and a recuperative heat exchanger.

EP-A-0326228 discloses a compact heating appliance for a dryer. The heating appliance includes a burner and a combustion chamber, the combustion chamber defining a U-shaped path. The combustion chamber is in communication with a recuperative heat exchanger.

In view of the high cost of the fuel necessary to generate the required heat for oxidation, it is advantageous to recover as much of the heat as possible. To that end, U.S. Pat. No. 3,870,474 discloses a thermal regenerative oxidizer comprising three regenerators, two of which are in operation at any given time while the third receives a small purge of purified air to force out any untreated or contaminated air therefrom and discharges it into a combustion chamber where the contaminants are oxidized. Upon completion of a first cycle, the flow of contaminated air is reversed through the regenerator from which the purified air was previously discharged, in order to preheat the contaminated air during passage through the regenerator prior to its introduction into the combustion chamber. In this way, heat recovery is achieved.

U.S. Pat. No. 3,895,918 discloses a thermal rotary regeneration system in which a plurality of spaced, non-parallel heat-exchange beds are disposed toward the periphery of a central, high-temperature combustion chamber. Each heat-exchange bed is filled with heat-exchanging ceramic elements. Exhaust gases from industrial processes are supplied to an inlet duct, which distributes the gases to selected heat-exchange sections depending upon whether an inlet valve to a given section is open or closed.

It would be desirable to take advantage of the efficiencies achieved with regenerative heat exchange in air flotation dryers.

SUMMARY OF THE INVENTION

The problems of the prior art have been overcome by the present invention, which provides an integrated web dryer and regenerative heat exchanger, as well as a method of drying a web of material using the same. The apparatus and method of the present invention provides for the heating of air and the converting of VOCs to harmless gases in a fully integrated manner via the inclusion of a regenerative combustion device as an integral element of the drying apparatus. In one embodiment, the dryer is an air flotation dryer equipped with air bars that contactlessly support the running web with heated air from the oxidizer.

DETAILED DESCRIPTION OF THE INVENTION

Fundamental to the realization of a fully integrated dryer and regenerative thermal oxidation device is the requirement that all of the energy needed for the drying process be derived from the combustion and conversion of the evolved VOCs with minimal or no added fuel. In accordance with the present invention, it is possible to achieve an auto-thermal or self-sustaining process mode. Many of the VOCs are exothermic in chemical reaction and as such may be considered as fuel in an integrated system displacing supplemental fuel, such as natural gas. The resulting apparatus provides high heat recovery effectiveness sufficient to provide an auto-thermal condition, or at least a very minimal supplemental fuel input, in a controlled and sustainable manner with high reliability of components and nearly complete conversion of undesirable volatile off-gases to harmless components.

Figure 1:
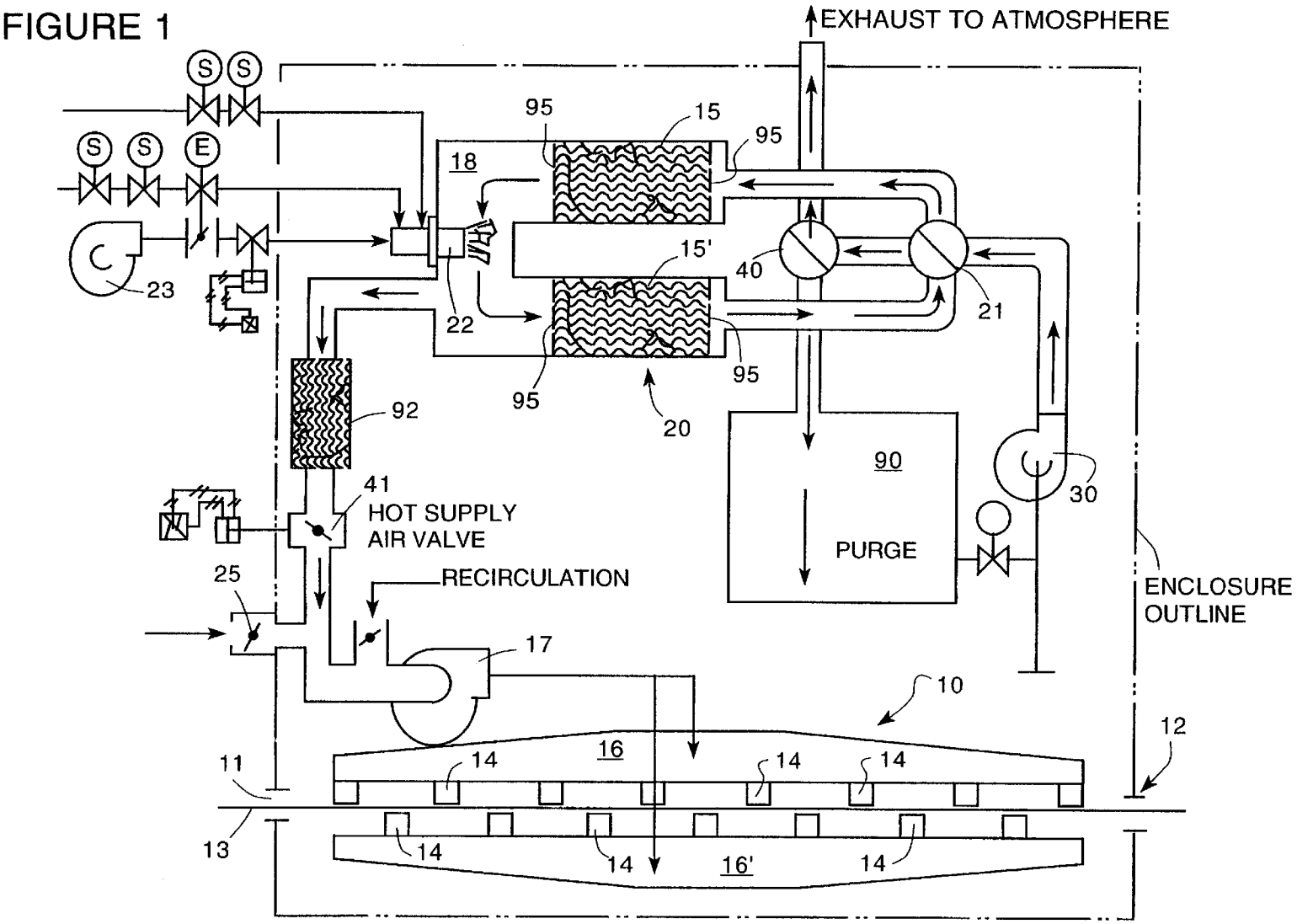
FIG. 1 is a schematic representation of one embodiment of the apparatus and process of the present invention.

Turning now to FIG. 1, there is shown schematically a single zone flotation dryer 10 with an integrated regenerative thermal oxidizer 20. The flotation dryer 10 includes a web inlet slot 11 and web outlet slot 12 spaced from the web inlet slot 11, through which a running web 13 is driven. In the dryer 10, the running web is floatingly supported by a plurality of air bars 14. Although preferably the air bars 14 are positioned in staggered opposing relation as shown, those skilled in the art will recognize that other arrangements are possible. To achieve good flotation and high heat transfer, HI-FLOAT® air bars commercially available from MEGTEC Systems are preferred, which float the web 13 in a sinusoidal path through the dryer 10. Enhanced drying can be achieved by incorporating infrared heating elements in the drying zone. The upper and lower sets of air bars are in communication with respective headers 16, 16', each of which receives a source of heated air via supply fan 17, and directs it to the respective air bars 14. A make-up air damper 25 is provided in communication with fan 17 to supply make-up air to the system where necessary. Those skilled in the art will appreciate that although a flotation dryer is illustrated, dryers where contactless support of the web is not necessary are also encompassed within the scope of the present invention.

The regenerative oxidizer 20 that is integrated with the dryer 10 is preferably a two-column oxidizer, although one column (FIGS. 7 and 8) with the burner in the inlet plenum or three or more columns or a rotary style could be used. With regenerative thermal oxidation technology, the heat transfer zones in each column must be periodically regenerated to allow the heat transfer media (generally a bed of ceramic stoneware or saddles) in the depleted energy zone to become replenished. This is accomplished by periodically alternating the heat transfer zone through which the cold and hot fluids pass. Specifically, when the hot fluid passes through the heat transfer matrix, heat is transferred from the fluid to the matrix, thereby cooling the fluid and heating the matrix. Conversely, when the cold fluid passes through the heated matrix, heat is transferred from the matrix to the fluid, resulting in cooling of the matrix and heating of the fluid. Consequently, the matrix acts as a thermal store, alternately accepting heat from the hot fluid, storing that heat, and then releasing it to the cold fluid.

The alternating of the heat transfer zones to provide matrix regeneration is accomplished via suitable switching valves. In one embodiment of the present invention, there is one switching valve per heat transfer zone, and preferably the switching valves are pneumatic poppet type valves whose switching frequency or cycle is a function of volumetric flow rate such that a reduced flow allows longer periods between switches. While the switching valves provide the means for matrix regeneration, the act of regeneration in itself results in a short duration emission of untreated fluid direct to atmosphere, causing a lowering of the volatile organic compound (VOC) destruction efficiency, and in cases involving high boiling point VOC's, potential opacity issues, unless some method of entrapment of this switching air is employed. Preferably, then, an entrapment chamber 90 is used to increase the efficiency of the apparatus.

FIG. 1 shows generally at 10 a two-column regenerative thermal oxidizer. The gas to be processed is directed from the dryer enclosure 10 to the oxidizer 20 via exhaust fan 30 and suitable ductwork, through suitable switching valve or valves 21, and into (or out of) one of the heat exchange media-filled regenerative heat exchange columns 15, 15'. A combustion zone 18 having associated heating means such as one or more gas-fired burners 22 with associated combustion blower 23 and gas line valving is in communication with each regenerative heat exchange column 15, 15', and is also in communication with dryer supply fan 17. Ideally, operation of the combustion zone heating means is necessary only during start-up, to bring the combustion zone 18 and heat exchange columns 15, 15' up to operating temperature. Once operating temperature is achieved, the heating means is preferably turned off (or placed in "pilot model") and an auto-thermal condition maintained. Suitable combustion zone 18 operating temperatures are generally within a range of 1400–1800° F. Those skilled in the art will appreciate that although the term "combustion zone" has typically been used in the industry to identify element 18, most or all of the combustion may take place in the heat exchange beds, and little or no combustion may actually take place in the combustion zone 18. Accordingly, use of this term throughout the specification and claims should not be construed as implying that combustion must take place in that zone.

Preferably the heat exchange columns 15, 15' are oriented horizontally (i.e., the flow of gas therethrough proceeds in a horizontal path) in the apparatus in order to economize space. In order to minimize undesirable accumulation of process gas and induce even distribution of process gas throughout the heat exchange media, preferably a combination of randomly packed media that includes voids which allow the passage of gas through the media particles, and structured media is used. In a preferred embodiment, the voids in the randomly packed media are larger than the voids existing in the interstices formed amongst the media particles. If the voids are too small, the gas will tend to flow in the interstices rather than through the voids in the particles. These exchange particles are fabricated of a single material and are characterized by protrusions or vanes extending from the center of the particle. Spaces between the protrusions provide an ideal void fraction for the passage of gases, thereby improving the pressure drop characteristics of the aggregate heat exchanger bed. This random packed media can also have a catalyst applied to the surface.

Those skilled in the art will recognize that other suitable shapes for the randomly packed media of the present invention can be used, including saddles, preferably ½" saddles, etc..

A second portion of the heat exchange media is a monolithic structure used in combination with the aforementioned randomly packed media. The monolithic structure preferably has about 50 cells/in$^2$, and allows for laminar flow and low pressure drop. It has a series of small channels or passageways formed therein allowing gas to pass through the structure in predetermined paths. Suitable monolithic structures are mullite ceramic honeycombs having 40 cells per element (outer diameter 150 mm×150 mm) commercially available from Porzellanfabrik Frauenthal GmbH. In the preferred embodiment of the present invention, monolithic structures having dimensions of about 5.91"×5.91"×12.00" are preferred. These blocks contain a plurality of parallel squared channels (40–50 channels per square inch), with a single channel cross section of about 3 mm×3 mm surrounded by an approximately 0.7 mm thick wall. Thus, a free cross section of approximately 60–70% and a specific surface area of approximately 850 to 1000 m$^2$/m$^3$ can be determined. Also preferred are monolithic blocks having dimensions of 5.91"×5.91"6". In some applications, a catalyst is applied to the monolith surface.

The relatively high flow resistant randomly packed portion of the media is preferably placed where the process gas to be treated enters the heat exchange column, thereby effectively assisting in distribution of the gas across the column cross section. The relatively low flow resistant monolithic portion of the media is preferably placed on the outlet of the randomly packed media, where gas distribution has already occurred. Inside a regenerative bed where oxidation is occurring, the exiting section of the bed has higher fluid temperatures than the inlet section. Higher temperature means both increased viscosity and increased actual velocity of the fluid, which then generate an elevated pressure drop. Thus, use of the structured media, which has an inherently lower pressure drop, in this portion of the column is advantageous.

Those skilled in the art will appreciate that a multi-layer bed of heat exchange media can consist of more than two distinct layers of media. For example, the randomly packed media at the inlet of a column can be a combination of different size saddles, such as a first layer of ½" saddles followed by a second layer of 1" saddles. The monolithic layer would then follow towards the outlet of the column. Similarly or in addition, the monolithic layer could be e.g., a first layer of monoliths having channel cross-sections of 3 mm×3 mm, followed by a second layer of monoliths having channel cross-sections of 5 mm×5 mm. In a system where only a single heat exchanger column is used, the multi-layer media bed can be a first layer of randomly packed media, a second layer of monolithic media, and a third layer of randomly packed media. Those skilled in the art will appreciate that the particular design of the multi-layer bed depends on desired pressure drop, thermal efficiency and tolerable cost.

Figure 2:
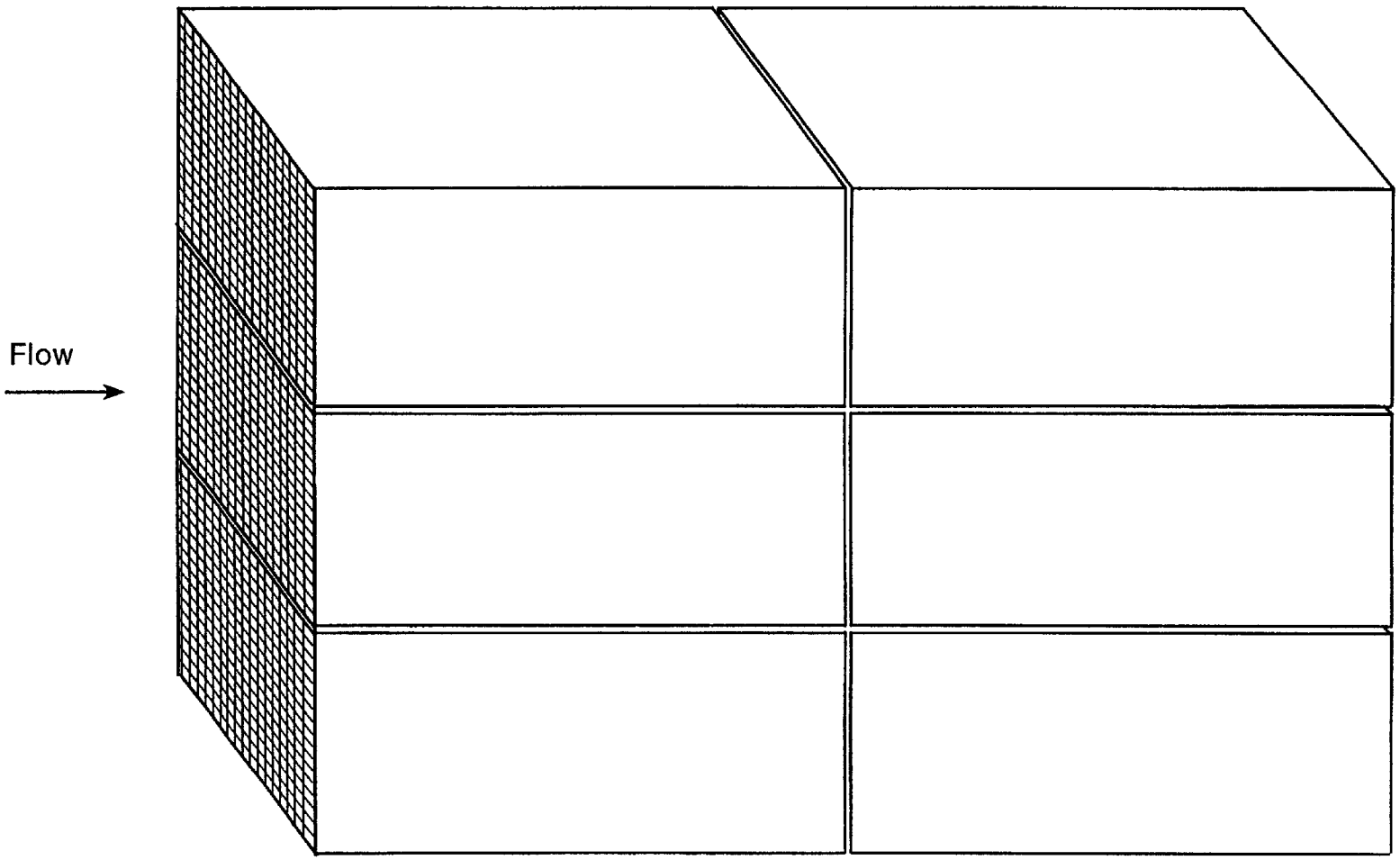
FIG. 2 is a perspective view of a monolith bed in accordance with the present invention.

Most preferred is a 100% monolith structure, as shown in FIG. 2. In the horizontal arrangement shown, the blocks are stacked to build the desired cross-sectional flow area and the desired flow length. To construct an integrated dryer with a regenerative oxidizer, including an entrapment chamber, which will fit into existing process lines such as a graphic arts printing press line, a compact heat exchange bed is required, which is best obtained with the monolith bed. An alternate monolith bed design would have a catalyst applied to the monolith surface. For a 100% monolith structure, the uniformity of the air flow into the monolith is critical to heat exchanger performance. In FIG. 1, flow spreading or distributing devices 95, such as perforated plates, are employed at the inlet and outlet of each column to evenly distribute air flow through the heat exchanger bed. Such flow distributors become optional where randomly packed media is used, since the randomly packed media helps distribute the air flow.

Suitable valving 40 is provided to direct gases to atmosphere or to purging inside the apparatus enclosure (or entrapment chamber 90) for optimal destruction efficiencies.

Suitable pressure and/or temperature attenuators 92 may be provided as shown in order to dampen the effects of valve switching during cycling of the regenerative heat exchanger. This valve switching can create pressure pulses and/or temperature spikes which can adversely affect dryer operation. The pressure pulses may enter the dryer through the hot air supply line and upset the slightly negative pressure (relative to atmosphere) of the dryer enclosure. This would allow solvent laden air to spill out of the dryer web slots. Temperature fluctuations which might occur during the switching process would make it more difficult to control the dryer air temperature at the desired setpoint. The attenuator 92 could reduce pressure pulses by introducing a flow resistance in the line feeding the dryer enclosure. The temperature fluctuations are reduced by introducing a device of high surface area and high thermal capacity into the flow line to the dryer enclosure.

The oxidizer is integrated with the dryer in the process sense; that is, the apparatus is a compact arrangement whereby the dryer is dependent upon the oxidizer for heat and for VOC clean-up. This can be accomplished by enclosing the oxidizer and dryer in a single enclosure, or by coupling the oxidizer to the dryer, or placing it in close proximity to the dryer. The oxidizer also can be heat insulated from the dryer. Preferably there is a common wall between the dryer and the heat exchange bed(s) of the oxidizer.

In one embodiment of the present invention, cooling air can be drawn past the oxidizer and added to the dryer interior as make-up air. This procedure cools the oxidizer and preheats the make-up air, adding to the efficiency of the system.

Figure 3:
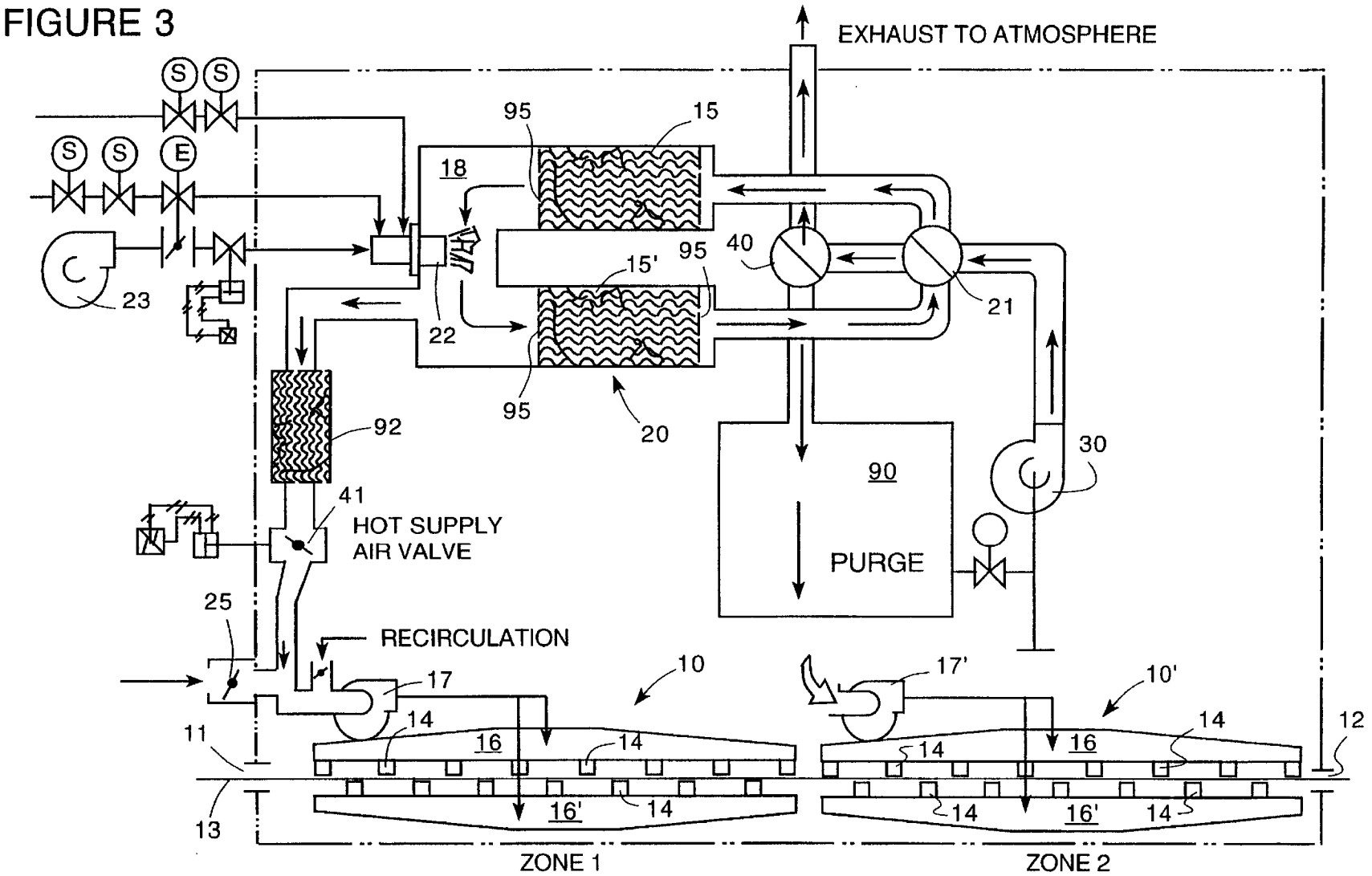
FIG. 3 is a schematic representation of a second embodiment of the present invention.

FIG. 3 shows a flotation dryer with an integrated regenerative thermal oxidizer as in FIG. 1, except that the dryer is a dual zone dryer with a hot air return. Each zone includes recirculating means 17, 17' such as a fan for supplying the air bars 14 with heated drying impingement air via suitable ductwork in communication with headers 16, 16'. Most of the supply of hot air to the first zone is from the regenerative thermal oxidizer, as regulated by the hot supply air valve 41. The second zone receives its supply of hot air from recirculation.

Figure 4:
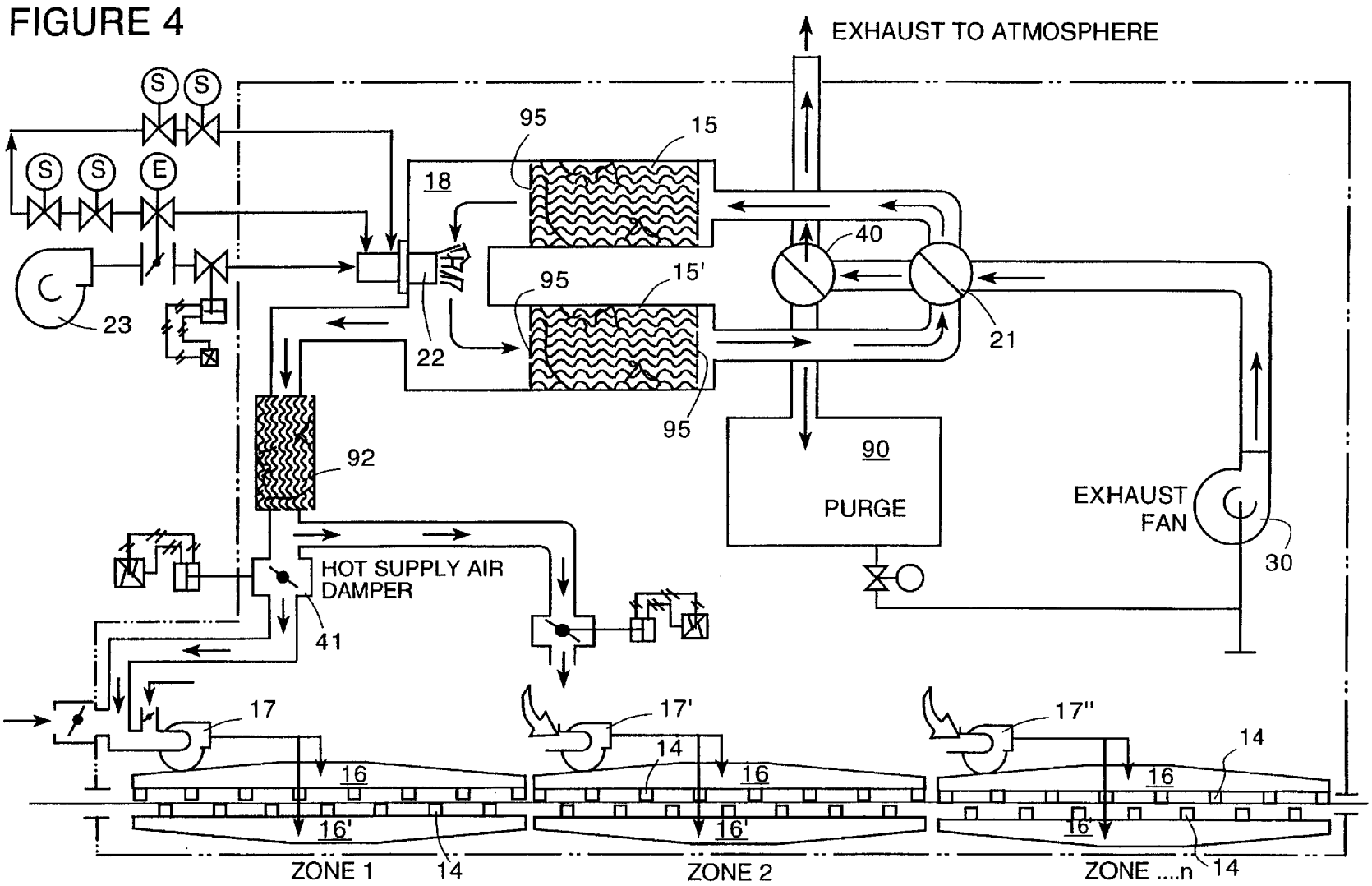
FIG. 4 is a schematic representation of a third embodiment of the present invention.

FIG. 4 shows a flotation dryer with an integrated regenerative thermal oxidizer as in FIG. 1, except that the dryer is a multiple zone dryer (three zones shown) with a hot air return. Each zone includes recirculating means 17, 17' such as a fan for supplying the air bars 14 with heated drying impingement air via suitable ductwork in communication with headers 16, 16'. All but the final zone receives most of the supply of hot air from the regenerative thermal oxidizer, as regulated by the hot supply air valve 41. The final zone receives its supply of hot air from recirculation.

Figure 5:
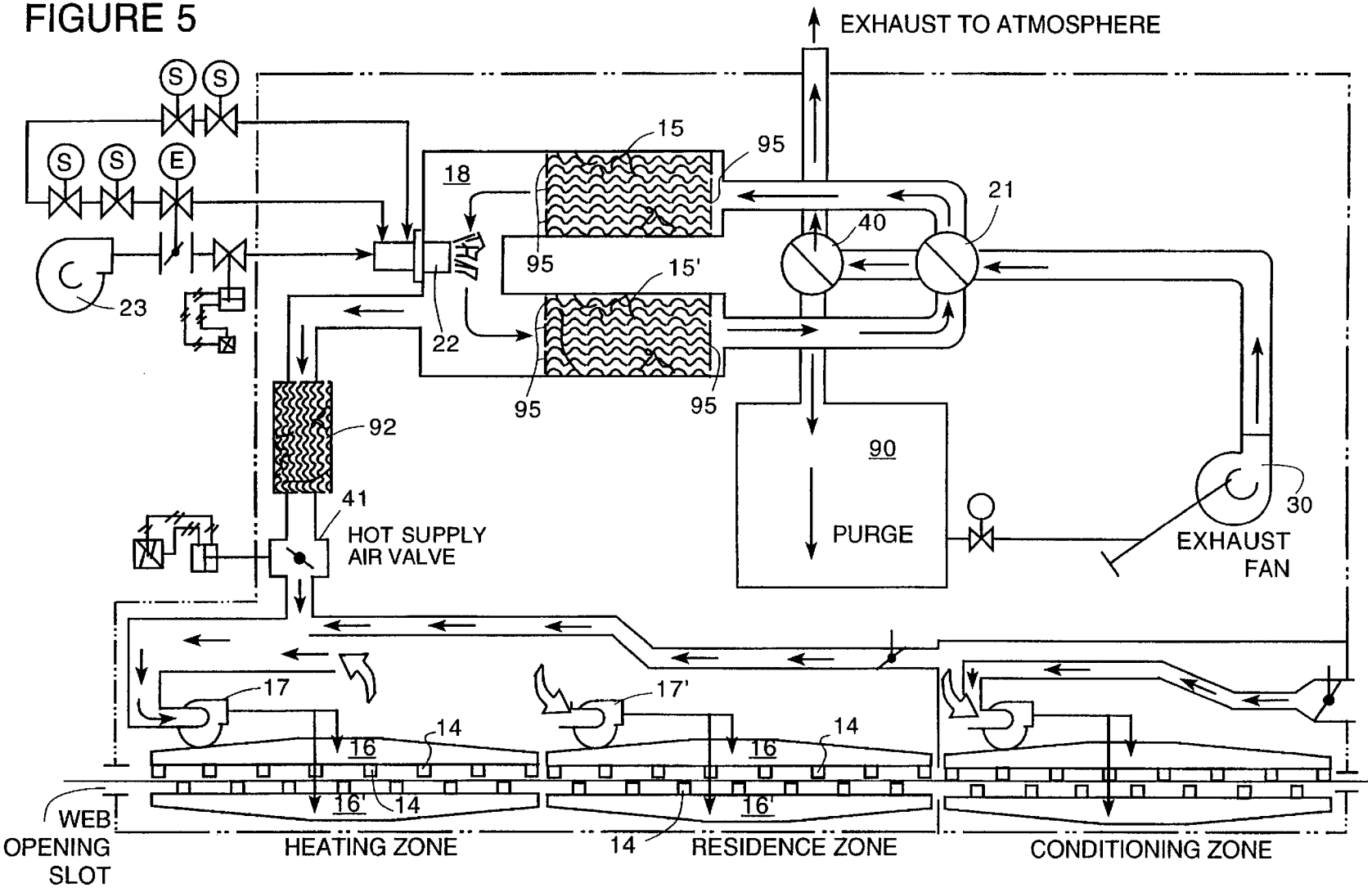
FIG. 5 is a schematic representation of a fourth embodiment of the present invention.

FIG. 5 shows a flotation dryer with an integrated regenerative thermal oxidizer as in FIG. 1, except that the dryer is a multiple zone dryer (three zones shown) with a hot air return, with the final zone being a conditioning zone. Each zone includes recirculating means 17, 17' such as a fan for supplying the air bars 14 with heated drying impingement air via suitable ductwork in communication with headers 16, 16'. The integrated conditioning zone is as described in U.S. Pat. No. 5,579,590, the disclosure of which is hereby incorporated by reference. The conditioning zone contains conditioned air that is substantially free of contaminants and is at a temperature low enough to absorb heat from the web, effectively lowering the solvent evaporation rate and mitigating condensation. Pressure control means 45 is provided so that solvent vapors will not escape from the dryer enclosure and so that ambient make-up air can be regulated as required via control means 46.

Figure 6:
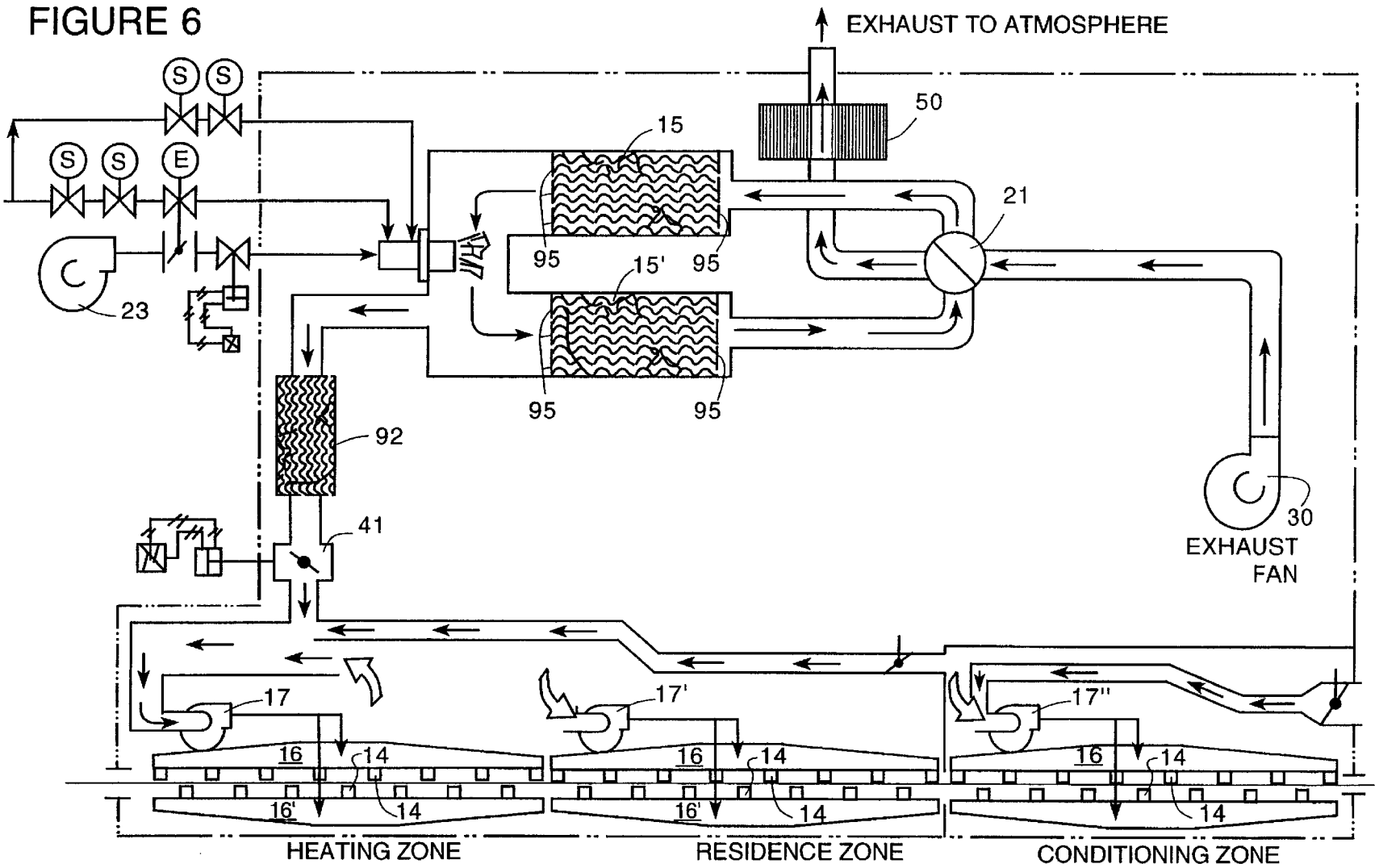
FIG. 6 is a schematic representation of a fifth embodiment of the present invention.

FIG. 6 shows an embodiment similar to FIG. 5, except that oxidizer purge to the dryer entrapment chamber (and corresponding valve) is eliminated. An optional catalytic stack cleaner 50 is shown for further destruction of VOCs being exhausted to atmosphere, in order to increase the overall efficiency of the apparatus.

Figure 7:
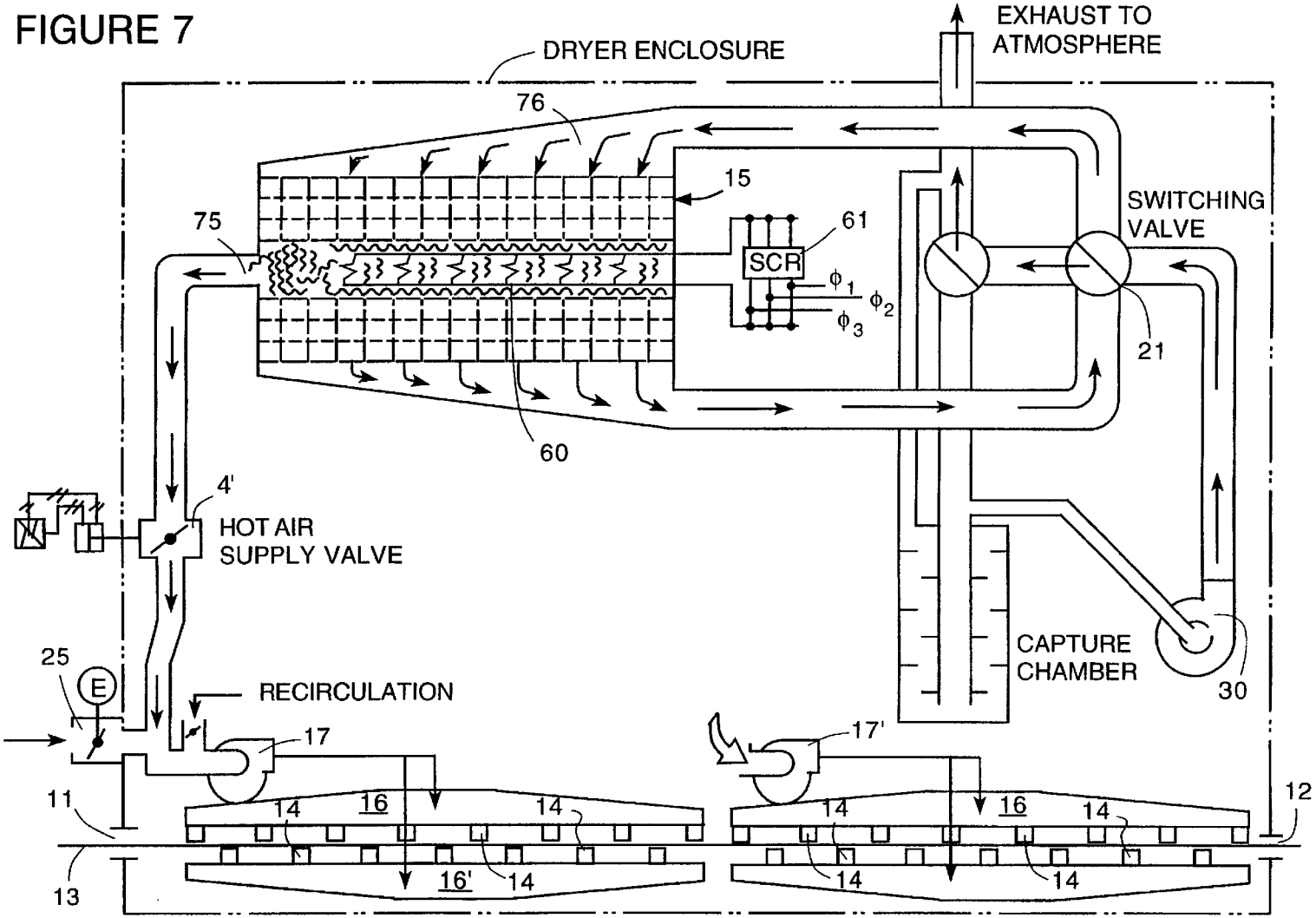
FIG.7 is a schematic representation of a single bed regenerative oxidizer integrated with a dryer.

Turning now to FIG. 7, there is shown a single bed oxidizer integrated with a two-zone air flotation dryer. Exhaust fan 30 draws solvent laden air from within the dryer enclosure and directs it to the regenerative oxidizer for treatment. The switching valve(s) 21 directs the air to the inlet side of the heat exchange media bed 15. (The inlet side of the media bed 15 alternates from one side of the bed to the other according to a predetermined switch time.) The heat exchange media bed 15 is a solitary accumulation of material with no occlusion for a combustion chamber. A combustion zone exists within the bed where sufficiently high bulk temperatures occur to convert VOCs to end products of carbon dioxide and water vapor. The location and size of the combustion zone may shift within the media bed 15 according to the particular combination of solvent/fuel rate, mass air flow rate and switch time. The heat exchange media may be comprised fully of any various types of random packing material or a combination of structured and randomly packed material. The preferred embodiment is a combination of media types in which the structured media is located at the so-called cold-faces of the bed and the randomly packed material is positioned in the center section of the bed. Thus the single bed heat exchange accumulation is preferably comprised of, in planar fashion, normal to the direction of air flow, first a depth of structured media followed by a section of randomly packed media and in turn immediately followed by a second section of structured media the same depth as the first. The orientation of the bed may be such that the flow is vertical or horizontal, but the flow must be normal to the planes of various media sections.

A suitable heat source such as fuel gas piping or preferably an electric heating element is located in the center, randomly packed media section for purposes of initially heating the exchange bed. It is intended that the electric element will be turned off at the time solvent and/or fuel is present in the bed. Preferably a combustible fuel, such as natural gas, is introduced into the gas to be treated prior to its entry into the heat exchange bed for purposes of sustaining bed temperatures when insufficient amounts of process solvent are available to support required combustion temperatures.

A portion of the combusting gases are drawn from the center of the heat exchange bed for purposes of mixing with and heating the supply air which is directed to the web of material 13. The hot gas is drawn from the center section of randomly packed material via a hot air collection plenum 75 which runs longitudinally along the center, randomly packed media section. The purpose of the plenum is to draw an even amount of gas from across the exchange media bed to prevent variations of temperature within the bed caused by an uneven flow regime.

The final supply air temperature which impinges on the web of material 13 is determined by the amount of hot gases mixed with recirculation air prior to the supply fan 17. The amount of hot gases is regulated by the hot air supply valve 4' that is in communication with the hot air collection plenum 75 attached to the heat exchange bed.

The regenerative heat source described is capable of supplying sufficient heat to a dryer consisting of one or more (two shown) distinct control zones as demarcated by individual supply fans. Heat from the oxidizer section may be directed to one or more of the individual zones as needed and under process control. The dryer design may incorporate one or more cooling zones operating in conjunction with and integrated to heating zone control. The atmosphere within the dryer is actively controlled via a make-up air damper 25.

Figure 8:
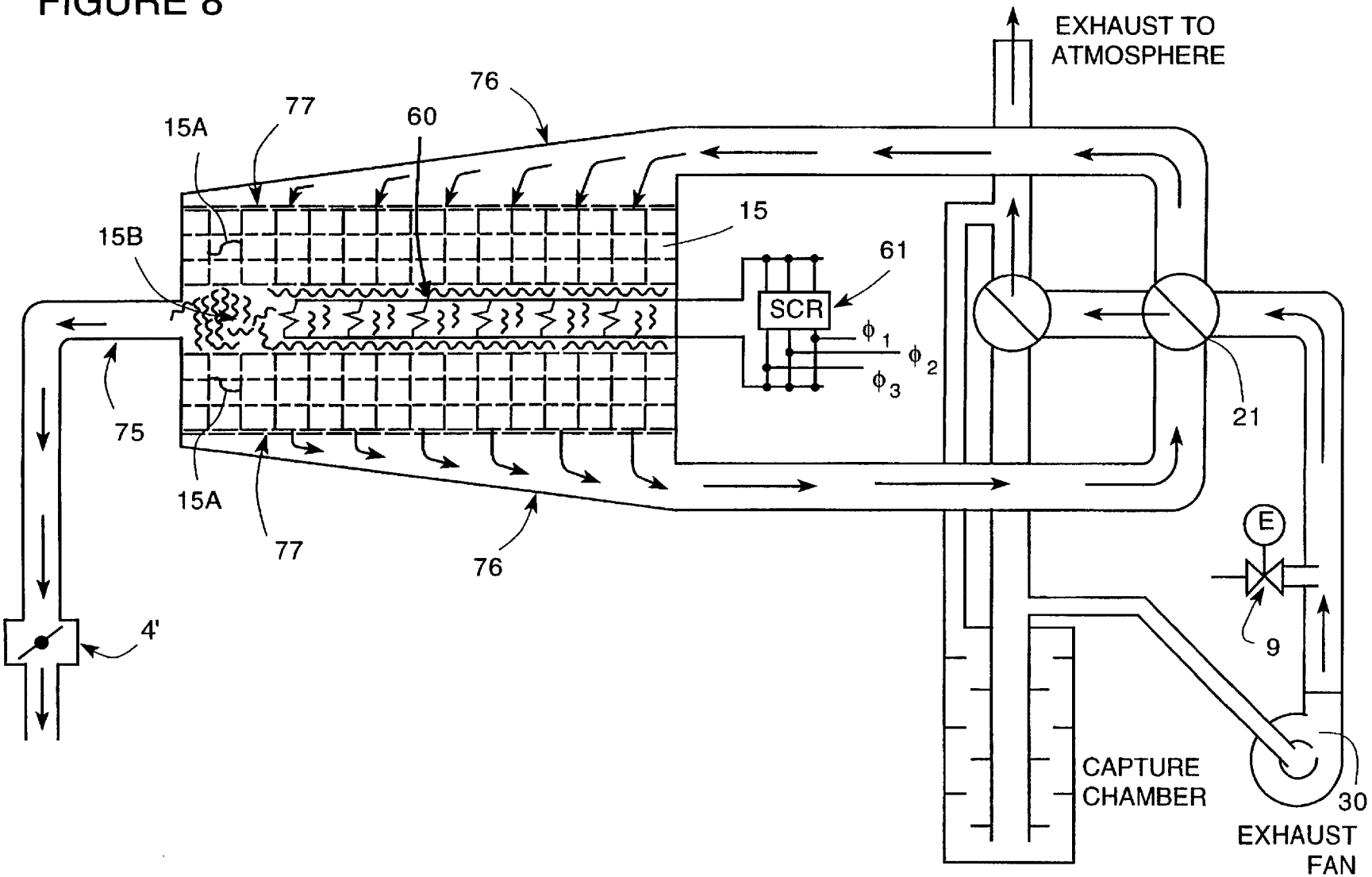
FIG. 8 is a schematic representation of the single bed regenerative oxidizer of FIG. 7.

FIG. 8 depicts the preferred embodiment of a heat exchange bed comprised of a solitary accumulation of heat exchange material with no enlarged occlusion for a combustion chamber. A described combustion zone exists within the bed around and about the center of the bed in the direction of flow. The size and location of the combustion zone is determined by a significant and sufficient rise in the temperature gradient within the bed such that combustion and conversion of volatile gases can occur. An inlet/outlet air distribution plenum 76 provides even velocity profiles to the cold faces of the heat exchange bed 15. A perforated distribution plate 77 may be provided just prior to the cold faces in the direction of air flow to provide for further evening of the velocity profile prior to entering the heat exchange bed. The heat exchange bed preferably consists of structured media 15A, which has excellent efficiency of pressure loss, and randomly packed media 15B, which allows for ease of embedding heating coils there within and allows for removal of hot gas to heat the supply air of the drying section. Heating means 60, preferably an electric resistance heating element, is controlled with power control 61 and heats the bed during start-up. Fuel gas injection valving 9 regulates the amount of fuel injected into the effluent to maintain a minimum combustible atmosphere within the combustion zone so as to support conversion of solvent and fuel to carbon dioxide and water vapor.

In any of the embodiments shown, to improve the VOC destruction efficiency and eliminate opacity issues resulting from matrix regeneration, the untreated fluid can be diverted away from the oxidizer stack and directed into a "holding vessel" or VOC entrapment chamber 90. The function of the entrapment chamber 90 is to contain the slug of untreated fluid which occurs during the matrix regeneration process long enough so that the majority of it can be slowly recycled (i.e., at a very low flow rate) back to the inlet of the oxidizer for treatment, or can be supplied to the combustion blower 23 as combustion air, or slowly bled to atmosphere through the exhaust stack. The untreated fluid in the entrapment chamber 90 must be entirely evacuated within the time frame allotted between matrix regeneration cycles since the process must repeat itself for all subsequent matrix regenerations.

In addition to its volume capacity, the design of the entrapment chamber 90 internals is critical to its ability to contain and return the untreated fluid back to the oxidizer inlet for treatment within the time allotted between heat exchanger matrix regeneration cycles. Any untreated volume not properly returned within this cycle will escape to atmosphere via the exhaust stack, thereby reducing the effectiveness of the entrapment device, and reducing the overall efficiency of the oxidizer unit.

For some operating conditions, the amount of volatile solvents in the dryer exhaust stream will be less than that required for autothermal operation. To avoid the use of a combustion burner to provide supplemental energy, supplemental fuel may be introduced into the system, such as in the exhaust stream, to provide the needed energy. A preferred fuel is natural gas or other conventional fuel gases or liquids. The elimination of the burner operation is advantageous because the combustion air required for burner operation reduces the oxidizer efficiency and can cause the formation of $NO_x$. Introduction of fuel gas can be accomplished by sensing temperature in some location, such as in the heat exchange columns. For example, temperature sensors can be located in each of the heat exchange beds, about 18 inches below the top of the heat exchange media in each bed. Once normal operation of the apparatus begins, combustible fuel gas is applied to the process gas, by means of a T-connection prior to the process gas entering the heat exchange column, based upon the average of the temperatures detected by the sensors in each heat exchange bed. If the average of the sensed temperatures falls below a predetermined setpoint, additional fuel gas is added to the contaminated effluent entering the oxidizer. Similarly, if the average of the sensed temperatures rises above a predetermined setpoint, the addition of fuel gas is stopped.

Alternatively, combustion zone temperature may be indirectly controlled by means of measuring and controlling the energy content of the exhaust air entering the oxidizer. A suitable Lower Explosive Limit (LEL) sensor such as is available from Control Instruments Corporation, can be used to measure the total solvent plus fuel content of the exhaust air at a suitable point following the pint of supplemental fuel injection. This measurement is then used to modulate by suitable control means the injection rate of fuel to maintain a constant, predetermined level of total fuel content, typically in the range of 5 to 35% of LEL, preferably in the range of 10 to 20% LEL. If the LEL measured by the sensor is below the desired setpoint, the amount of supplemental fuel injected is increased such as by opening the control valve 9. If the LEL measured is above the setpoint, the supplemental fuel injection rate is reduced such as by closing the flow valve 9. IN the case that the solvent content from the drying process is higher than the desired LEL setpoint even with no fuel injection, the exhaust rate from the drying process may be increased to reduce the LEL such as by adjusting flow through the exhaust fan 30. This adjustment of exhaust flow is well known to those skilled in the art, and is preferably accomplished with a variable speed drive on fan 30, or by a flow control damper.

If the concentration of combustible components in the gas to be treated becomes too high, excessive temperatures will occur in the apparatus that may be damaging. To avoid such excessive temperatures in the high temperature incineration or combustion zone, temperature can be sensed such as with a thermocouple appropriately positioned in the combustion zone and/or in one or more of the heat exchange columns, and when a predetermined high temperature is reached, the gases that normally would be passed through the cooling heat exchange column can be instead bypassed around that column. When placed in the heat exchange columns, the particular location of the temperature sensors is not absolutely critical; they can be located six inches, twelve inches, eighteen inches, twenty-four inches below the top of the media, for example. Preferably the sensors are placed from about 12 to 18 inches below the top of the media. Each sensor is electrically coupled to a control means. A hot bypass duct/damper receives a signal from the control means that modulates the damper to maintain a temperature as measured by the sensor to a predetermined set point. Those skilled in the art will appreciate that the actual set point used depends in part on the actual depth of the temperature sensor in the stoneware, as well as on the combustion chamber set point. A suitable set point is in the range of from about 1600° F. to about 1650° F. The bypassed gases can be exhausted to atmosphere, combined with other gases that have already been cooled as a result of their normal passage through the cooling heat exchange column or used for some other purpose.

What is claimed is:

1. A dryer for a web of material and having an integrated regenerative heat source, comprising:

a web inlet and a web outlet spaced from said web inlet;

a plurality of nozzles for drying said web;

a regenerative heat source comprising at least one heat exchange column, said at least one column having a gas inlet and a gas outlet, said at least one column being in communication with a combustion zone, and containing heat exchange material;

valve means for alternatingly directing gas from said dryer into said inlet of said at least one heat exchange column; and means in communication with said combustion zone for directing a portion of the gas therein to one or more of said plurality of nozzles.

2. The dryer of claim 1, wherein there are at least two heat exchange columns.

3. The dryer of claim 1, wherein at least some of said plurality of nozzles are flotation nozzles for floatingly supporting said web in said housing enclosure.

4. The dryer of claim 1, 2 or 3, wherein said heat exchange material is a combination of randomly packed media and structured media.

5. The dryer of claim 1, 2 or 3, wherein said heat exchange material is a monolith.

6. The dryer of claim 2 or 3, further comprising an entrapment chamber having an inlet in communication with said valve means.

7. The dryer of claim 1, 2 or 3, further comprising means for introducing a combustible fuel into said at least one heat exchange column.

8. The dryer of claim 1, 2 or 3, wherein said heat exchange material comprises a catalyst.

9. The dryer of claim 1, 2 or 3, further comprising attenuating means in communication with said combustion zone.

10. The dryer of claim 9, wherein said attenuating means attenuates pressure.

11. The dryer of claim 9, wherein said attenuating means attenuates temperature.

12. The dryer of claim 1, further comprising temperature sensing means in said regenerative heat source, and bypass means responsive thereto for extracting a portion of gases from said regenerative heat source when said temperature sensing means senses a predetermined temperature.

13. The dryer of claim 1, further comprising a sensor for sensing the concentration of volatile organic solvent of said gas directed into said inlet.

14. The dryer of claim 7, further comprising a sensor for sensing the concentration of volatile organic solvent of said gas directed into said inlet, and wherein the amount of said combustible fuel introduced is responsive to the sensed concentration.

15. A method of drying a running web of material, comprising:

transporting said web into a dryer having a dryer atmosphere;

impinging heated gas onto said web with a plurality of nozzles;

drawing a portion of said dryer atmosphere into an integrated regenerative heat source comprising at least one heat exchange column in communication with a combustion zone and containing heat exchange material in order to heat said portion of said dryer atmosphere;

combusting in said regenerative heat source volatile contaminants contained in said dryer atmosphere; and directing a portion of the combusted gas from said regenerative heat source to one or more of said plurality of nozzles.

16. The method of claim 15, further comprising sensing the concentration of volatile contaminants in said dryer atmosphere.

17. The method of claim 15 or 16, further comprising introducing a combustible fuel into said at least one heat exchange column.

18. The method of claim 17, wherein the amount of combustible fuel gas introduced is responsive to the sensed concentration of volatile contaminants.

* * * * *